US012655590B2

(12) United States Patent
Liu et al.

(10) Patent No.: US 12,655,590 B2
(45) Date of Patent: Jun. 16, 2026

(54) HIGH-PRESSURE BEARABLE SCALE TYPE BRIDGE RUBBER BEARING

(71) Applicants: CHINA RAILWAY CONSTRUCTION BRIDGE ENGINEERING BUREAU GROUP CO., LTD., Tianjin (CN); Shenyang University of Technology, Shenyang (CN)

(72) Inventors: Peng Liu, Panjin (CN); Jian Zhao, Tianjin (CN); Luming An, Hengshui (CN); Xianyu Ji, Gaobeidian (CN); Yuanqing Wang, Beijing (CN); Guannan Zhou, Tianjin (CN); Lilong Fan, Tianjin (CN); Yanlong Ren, Shenyang (CN); Lei Wang, Da'an (CN); Hongping Lu, Zhucheng (CN); Yixuan Chen, Dezhou (CN)

(73) Assignees: CHINA RAILWAY CONSTRUCTION BRIDGE ENGINEERING BUREAU GROUP CO., LTD., Tianjin (CN); Shenyang University of Technology, Shenyang (CN)

( * ) Notice: Subject to any disclaimer, the term of this patent is extended or adjusted under 35 U.S.C. 154(b) by 888 days.

(21) Appl. No.: 17/985,716

(22) Filed: Nov. 11, 2022

(65) Prior Publication Data

US 2023/0071770 A1 Mar. 9, 2023

(51) Int. Cl.
*E01D 19/04* (2006.01)

(52) U.S. Cl.
CPC ..... *E01D 19/041* (2013.01)

(58) Field of Classification Search
CPC ..... E01D 19/04; E01D 19/041
See application file for complete search history.

(56) References Cited

U.S. PATENT DOCUMENTS 4,117,637 A * 10/1978 Robinson ..... F16F 1/50 52/167.1
4,499,694 A * 2/1985 Buckle ..... E04B 1/98 52/167.7

(Continued)

FOREIGN PATENT DOCUMENTS

CN 107964871 A 4/2018
CN 208456246 U 2/2019

(Continued)

*Primary Examiner* — Abigail A Risic
(74) *Attorney, Agent, or Firm* — JEEN IP LAW, LLC

(57) ABSTRACT

A high-pressure bearable scale type bridge rubber bearing is disclosed, which comprises spring rubber vibration reduction pad assemblies, a flexible steel plate assembly and a rubber bearing body. The rubber bearing body comprises an outer rubber portion and an inner rubber portion; the outer rubber portion is wrapped around the outside of the spring rubber vibration reduction pad assemblies and the flexible steel plate assembly; the spring rubber vibration reduction pad assemblies are arranged on the upper side and the lower side of the inner rubber portion; and the flexible steel plate assembly is fixedly mounted between the spring rubber vibration reduction pad assemblies. The rubber bearing of the present invention has a relatively large elastic deformation after being loaded and can effectively conduct vibration reduction and earthquake resistance during use.

9 Claims, 5 Drawing Sheets

(56) References Cited

U.S. PATENT DOCUMENTS

| | | | | | |
|---|---|---|---|---|---|
| 4,887,788 | A * | 12/1989 | Fischer | E01D 19/041 | 267/140.11 |
| 8,789,320 | B1 * | 7/2014 | Bradford | E01D 19/041 | 52/167.6 |
| 2006/0137264 | A1 * | 6/2006 | Shizuku | E04H 9/022 | 52/167.7 |
| 2006/0272226 | A1 * | 12/2006 | Robinson | E01D 19/04 | 52/167.4 |

FOREIGN PATENT DOCUMENTS

| | | | | |
|---|---|---|---|---|
| CN | 113294469 | A * | 8/2021 | F16F 3/12 |
| CN | 216040635 | U | 3/2022 | |
| JP | 3039846 | B2 * | 5/2000 | |
| JP | 2018178653 | A * | 11/2018 | |

* cited by examiner

HIGH-PRESSURE BEARABLE SCALE TYPE BRIDGE RUBBER BEARING

TECHNICAL FIELD

The present invention relates to the technical field of bridge engineering, in particular to a high-pressure bearable scale type bridge rubber bearing.

BACKGROUND

Before the 1960s, bridge bearings in China were mostly rigid bearings; and early small and medium bridges mostly used bearings with asphaltic felts etc. in a relatively low technological level and a simple design. Afterwards, due to a great number of disadvantages arising, rubber bearings were introduced into China. In the mid of 1970s, Ministry of Railways of China first applied the rubber bearing to Jingbao Railway, which have a history over 20 years. In the last decade, with the large-scale establishment of highway bridges and railroad bridges, the use of the bearings is sharply increased. Therefore, production of the rubber bearing has become a novel industry at home and abroad.

The rubber bearings are mainly classified into a circular plate type rubber bearing, a rectangular plate type rubber bearing, a polytetrafluoroethylene plate type rubber bearing, a basin rubber bearing and a spherical-crown-shaped plate type rubber bearing.

At present, almost all of the newly established highway bridges use various rubber bearings. The important reasons for wide application are that the rubber bearing is simple in construction, liable to process and manufacture, low in cost and convenient to mount, has the outstanding advantages of vibration reduction, earthquake resistance, large deformation and the like. it is very beneficial to use rubber bearings serving as bridge bearings.

Meanwhile, there are also some problems in the use process of the bridge rubber bearing.

1. Fracturing cracks. The most common quality problem of the rubber bearing is skin ripples caused by uneven bulges; and the root cause of this phenomenon is that rubber is difficult to stress and shows an uneven scale under the effect of a high-pressure load. Many rubber bearings will have fracturing cracks itself after being used for certain years, but the fracturing situation is not particularly severe; however, a great number of bulges and cracks flush on some bearings, and the self quality problem occupies a large proportion.
2. Exposure of steel plate. In general, this is caused by not following the interior construction principle in the manufacturing process of the bearing; there should be a wearproof insulator inside, but most of the rubber bearings ignore this step for cost conservation.
3. Bearing disengagement. This phenomenon is relatively serious. When slit corner degrees formed by the rubber bearing to the bottom surface of the bridge and the side surface of a bearing pad stone are too large, it can prompt the top surface and the bottom surface of the bearing to make complete contacts to the bridge. Thus, increase in partial air pressure of the external bearing is easily caused, so that original pressure of the pad stone cannot be counteracted, and then the bearing is firmly lifted up to cause partial disengagement.

In addition to the problems arising in the use process, the rubber bearing also has the problems in quality.

Materials of rubber and metal plates selected by existing manufacturers are not standardized in variety and specification; after the materials are dissected, it is discovered that many constructions are not reasonable, thicknessnes of rubber layers are uneven, and the thickness and the number of layers of a metal plate are not standardized; and the manufacturing process is not reasonable, showing that a bonding power between the rubber layer and the metal plate is not sufficient.

In 2000, there were several bridges in Guangdong Section, Jingzhu Expressway. The rubber bearings mostly cracked just when girders were lifted and mounted, and the rubber bearings had to be changed. In 2001, the rubber bearing oil New North River Bridge on National Road 107 in Qingyuan County, Guangdong Province had been used for more than 3 years and were mostly damaged, so as to have to be changed.

Now, a bridge rubber bearing structure with stronger vibration reduction and earthquake resistance effects and a manufacturing method therefor which are capable of solving the above problems are needed.

SUMMARY

The present invention provides a high-pressure bearable scale type bridge rubber bearing. By making technical modifications on an existing rubber bearing, the high-pressure bearable scale type bridge rubber bearing fully exerts the performance advantages of a spring rubber vibration reduction pad and an arch-shaped flexible steel plate, which may mitigate noise produced by a structure and improve the durability of the rubber bearing while greatly assisting vibration reduction and earthquake resistance of a bridge.

In order to achieve the above objective, the present invention employs the following technical solution:

A high-pressure bearable scale type bridge rubber bearing, comprising spring rubber vibration reduction pad assemblies, a flexible steel plate assembly and a rubber bearing body. The rubber bearing body comprises an outer rubber portion and an inner rubber portion; the outer rubber portion is wrapped around the outside of the spring rubber vibration reduction pad assemblies and the flexible steel plate assembly; the spring rubber vibration reduction pad assemblies are arranged on the upper side and the lower side of the inner rubber portion; the flexible steel plate assembly is fixedly mounted between the spring rubber vibration reduction pad assemblies; and the spring vibration reduction assemblies and the flexible steel plate assembly are wrapped around the inner rubber portion.

Preferably, the flexible steel plate assembly comprises a plurality of arch-shaped flexible steel plates; the arch-shaped flexible steel plates are mutually combined and spliced in a successive lap joint manner to form a cylindrical structure with a waist sunken; and the inner rubber portion is arranged in the cylindrical structure.

Preferably, a zigzag type splicing opening is formed between adjacent arch-shaped flexible steel plates; and in a cross section, an upper steel plate of each arch-shaped flexible steel plate is successively in lap joint to a lower steel plate of the arch-shaped flexible steel plate before.

Preferably, the outer side surface of the outer rubber portion is a sunken arch-shaped curved surface.

Preferably, each spring rubber vibration reduction pad assembly comprises an upper steel plate layer, a lower steel plate layer, fixing bolts, springs and fixed columns; a plurality of fixed columns are fixedly arranged on the upper surface of the lower steel plate layer at uniform intervals; threaded holes are formed in the fixed columns; through holes are formed in the upper steel plate layer; the upper steel plate layer is fixed to the fixed columns by making the fixing bolts penetrate through the through holes; and the springs are sleeved at the peripheries of the fixed columns.

Preferably, the fixed columns are specifically arranged in a circular array; and heights of the springs sleeved outside the fixed columns are identically set.

Preferably, a gasket is arranged between each fixing bolt and the upper surface of the upper steel plate layer.

Preferably, the fixed column is of an eccentric elliptic platform shaped structure; and an ellipse on the bottom surface, an ellipse on the top surface and the side surface of an eccentric elliptic platform form a symmetric key shaped body.

Preferably, a length of a long axis of the ellipse on the bottom surface of the fixed column is consistent to a radius of the spring.

Preferably, each fixed column is made of rubber with viscoelasticity, weak hardness and high damping.

The present invention has the beneficial effects that:

In the present invention, the arch-shaped outer rubber portion thoroughly changes structural forms of previous rubber bearings; and in the arch-shaped outer rubber portion, an original linear segment is transformed into a curve from the top surface to the bottom surface, and the arch-shaped outer rubber portion is thoroughly wrapped around the interior arch-shaped flexible steel plates. Therefore, the present invention is stronger in bearing capacity and can more effectively reduce vibration and resist an earthquake.

The present invention can effectively conduct vibration reduction and earthquake resistance during use of the rubber bearing. By using small elasticity modulus of each spring, the rubber bearing has a relatively large elastic deformation after being loaded and can effectively absorb shock and vibration. A combined arch-shaped flexible steel plate assembly can produce an inward horizontal thrust when bearing a vertical reaction caused by a self weight of the structure, a secondary load and a live load, and is stronger in bearing capacity.

Meanwhile, the combined arch-shaped flexible steel plate of the present invention can further exert the sealing effect to interior rubber and may delay season cracking of the rubber.

Figure 1:
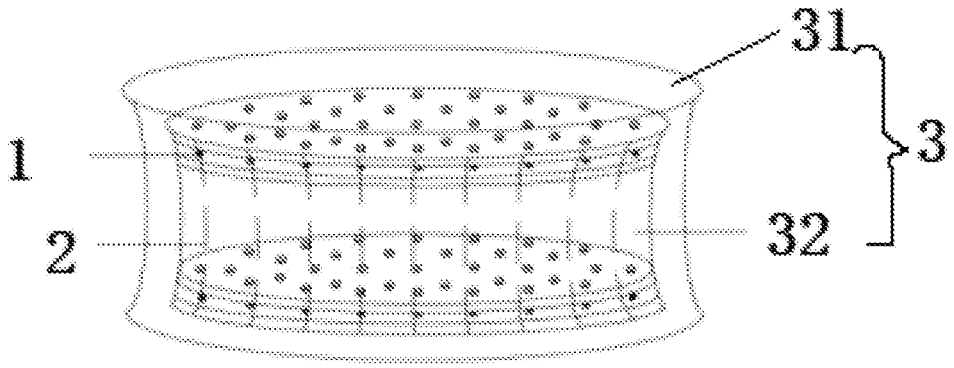
FIG. 1 is a schematic diagram of a structure of a bridge rubber bearing.

Description of reference numerals: spring rubber vibration reduction pad assembly 1, upper steel plate layer 11, lower steel plate layer 12, fixing bolt 13, spring 14, fixed column 15, threaded hole 151, flexible steel plate assembly 2, arch-shaped flexible steel plate 21, splicing opening 22, rubber bearing body 3, outer rubber portion 31, inner rubber portion 32, through hole 4, gasket 5.

DETAILED DESCRIPTION OF THE EMBODIMENTS

The specific content of the present invention is described in detail below in combination with the drawings and the embodiments.

Figure 2:
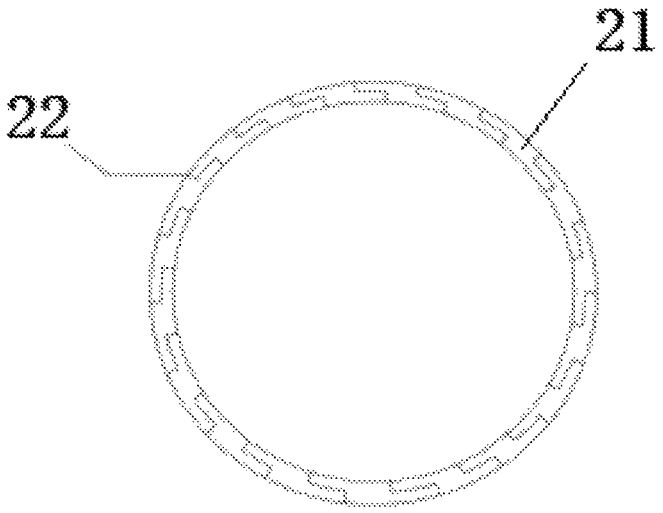
FIG. 2 is a cross-sectional view of splicing of a combined flexible steel plate.
Figure 3:
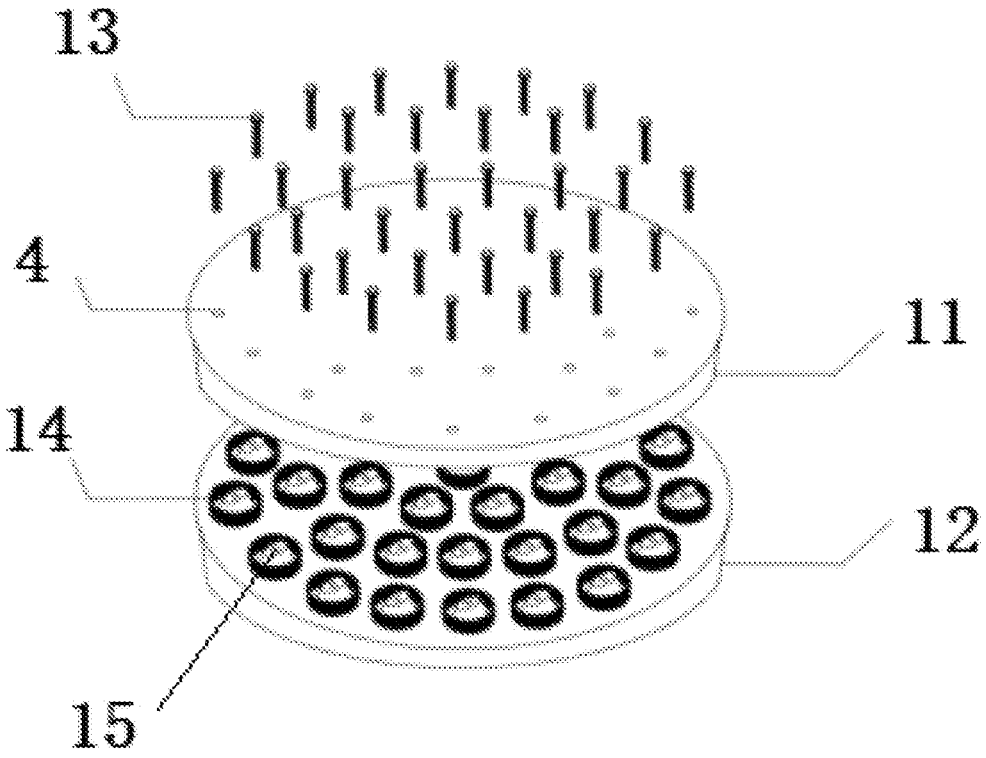
FIG. 3 is a schematic diagram of a structure of a spring rubber vibration reduction pad assembly.
Figure 4:
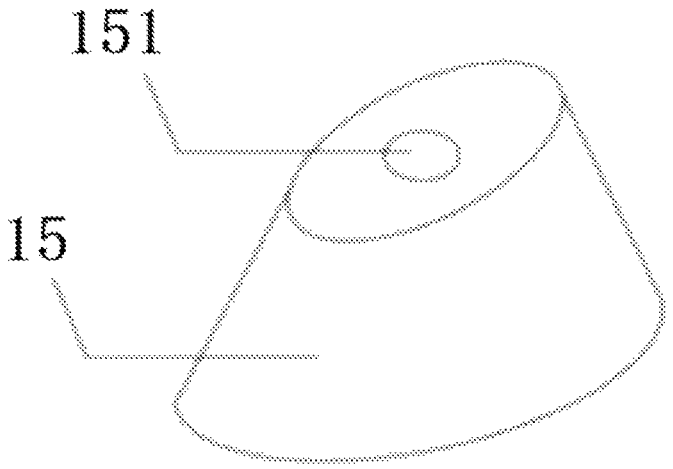
FIG. 4 is a diagram showing a detail regarding a construction of a fixed column.
Figure 5:
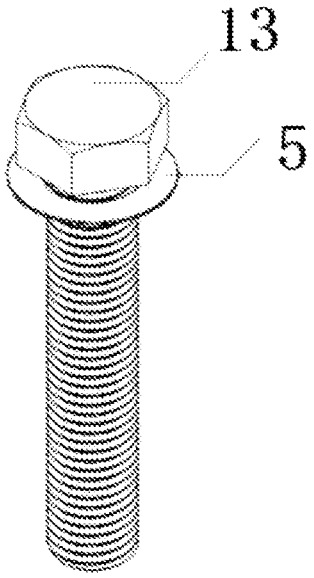
FIG. 5 is a diagram showing a detail regarding a bolt.

Referring to FIGS. 1-5, the present invention provides a high-pressure bearable scale type bridge rubber bearing, comprising spring rubber vibration reduction pad assemblies 1, a flexible steel plate assembly 2 and a rubber bearing body 3. The rubber bearing body 3 comprises an outer rubber portion 31 and an inner rubber portion 32; the outer rubber portion 31 is wrapped around the outside of the spring rubber vibration reduction pad assemblies 1 and the flexible steel plate assembly 2; the spring rubber vibration reduction pad assemblies 1 are arranged on the upper side and the lower side of the inner rubber portion 32; the flexible steel plate assembly 2 is fixedly mounted between the spring rubber vibration reduction pad assemblies 1; and the spring rubber vibration reduction pad assemblies 1 and the flexible steel plate assembly 2 are wrapped around the inner rubber portion 32.

Further, the flexible steel plate assembly 2 comprises a plurality of arch-shaped flexible steel plates 21; the arch-shaped flexible steel plates 21 are mutually combined and spliced in a successive lap joint manner to form a cylindrical structure with a waist sunken; and the inner rubber portion 32 is arranged in the cylindrical structure. The arch-shaped flexible steel plates 21 are successively in lap joint to surround the inner rubber portion 32 and upper and lower groups of circular spring rubber vibration reduction pad assemblies 1 to form a closed a circle.

Further, in order to obtain stronger splicing tightness and supporting strength, a zigzag type splicing opening 22 is formed between adjacent arch-shaped flexible steel plates 21; and in a cross section, an upper steel plate of each arch-shaped flexible steel plate 21 is successively in lap joint to a lower steel plate of the front arch-shaped flexible steel plate 21, wherein the combined arch-shaped flexible steel plate 21 can produce an inward horizontal thrust when bearing a vertical reaction caused by a self weight of the structure and a secondary load, and transversely extrudes the interior rubber to make the bearing capacity of the rubber better; and when the combined arch-shaped flexible steel plate 21 bears an overlarge load produced by the bridge, each arch-shaped flexible steel plate assembly 2 can produce a deformation and is rapidly restored.

Further, the outer side surface of the outer rubber portion 31 is a sunken arch-shaped curved surface. In the arch-shaped outer rubber portion 31, an original linear segment is transformed into a curve from the top surface to the bottom surface, and the arch-shaped rubber is thoroughly wrapped around the interior arch-shaped flexible steel plates 21.

Further, each spring rubber vibration reduction pad assembly 1 comprises an upper steel plate layer 11, a lower steel plate layer 12, Fixing bolls 13, springs 14 and fixed columns 15; a plurality of fixed columns 15 are fixedly arranged on the upper surface of the lower steel plate layer 12 at uniform intervals; threaded holes 151 are formed in the fixed columns 15; through holes 4 are formed in the upper steel plate layer 11; the upper steel plate layer 11 is fixed to the fixed columns 15 by the fixing bolts 13 penetrating through the through holes 4; and the springs 14 are sleeved at the peripheries of the fixed columns 15. The through holes 4 formed in the steel plate are circular holes and have diameters slightly larger than those of the fixing bolts 13. Through the springs 14 arranged at the externals of the fixed columns 15, the springs 14 are distributed at an equal interval; by using small elasticity modulus of the springs 14, the springs 14 have the characteristics of having large elastic deformations after being loaded and effectively absorbing shocks and vibration, and then the overall elasticity of the structure is improved; and meanwhile, by using the principle that the rigidity is improved after parallel connection of the springs 14, the overall rigidity of the spring rubber vibration reduction pad assemblies 1 is improved, and the overall bearing capacity is increased.

Further, the fixed columns 15 are specifically arranged in a circular array; and heights of the springs 14 sleeved outside the fixed columns 15 are identically set.

Further, a gasket 5 is arranged between each fixing bolt 13 and the upper surface of the upper steel plate layer 11. Depths of the threaded holes 151 are adjustably set; the fixing bolts 13 are arranged as outer hexagon bolts; the gaskets 5 are further sleeved on the fixing bolts 13; and the bottoms of the gaskets 5 are attached to the tops of upper round steel plates.

Further, each fixed column 15 is of an eccentric elliptic platform shaped structure; and an ellipse on the bottom surface, an ellipse on the top surface and the side surface of an eccentric elliptic platform form a symmetric key shaped body. An eccentric elliptic platform shaped structure of each fixed column 15 facilitates bearing of a horizontal force produced in a direction of a bridge axis.

Further, a length of a long axis of the ellipse on the bottom surface of the fixed column 15 is consistent to the radius of each spring 14.

Further, in order to obtain stronger load bearing strength and buffering effect, each fixed column 15 is made of rubber with viscoelasticity, weak hardness and high damping.

This embodiment of the present invention can effectively conduct vibration reduction and earthquake resistance during use of the rubber bearing. By using small elasticity modulus of each spring 14, the rubber bearing has a relatively large elastic deformation after being loaded and can effectively absorb shock and vibration. The arch-shaped flexible combined steel plate is set to be capable of applying a reverse horizontal thrust to the interior when being under a load produced by an upper portion; and meanwhile, the combined steel plate can further exert the sealing effect to the interior rubber and may delay season cracking of the rubber.

At last, it should be noted that the above embodiments are only used to illustrate the technical solutions of the present invention and shall not be construed as limitation. Although the present invention is described in detail with reference to preferred embodiments, ordinary skill in the art should understand that modifications or equivalent substitutions may be made on the technical solutions of the utility model without departing from the spirit and the scope of the technical solutions of the present invention, all of which should be contained within the scope of the claims of the present invention.

The used standard parts in the present invention may all be commercially available, and special-shaped parts may be customized according to descriptions in the specification and the drawings. The specific connecting modes of various parts may employ mature conventional means such as bolts, rivets and welding in the prior art; the used machinery, parts and devices are all of conventional models in the prior art; and circuit connection employs a conventional connection mode in the prior art, which will not be described in detail any more here.

In description of the present invention, unless otherwise expressly specified and defined, the terms "mounted", "connected", "coupled" and "fixed" should be understood broadly, for example, as fixed connection, detachable connection or integration; mechanical connection or electrical connection; direct connection, connection through an intermediary medium, communicating between interiors of two elements or interacting between two elements. The meanings of above terms in the present invention may be understood in specific cases to those skilled in the art.

What is claimed is:

1. A high-pressure bearable scale type bridge rubber bearing, comprising spring rubber vibration reduction pad assemblies, a flexible steel plate assembly and a rubber bearing body, wherein the rubber bearing body comprises an outer rubber portion and an inner rubber portion; the outer rubber portion is wrapped around the outside of the spring rubber vibration reduction pad assemblies and the flexible steel plate assembly; the spring rubber vibration reduction pad assemblies are arranged on the upper side and the lower side of the inner rubber portion; the flexible steel plate assembly is fixedly mounted between the spring rubber vibration reduction pad assemblies; and spring rubber vibration reduction assemblies and the flexible steel plate assembly are wrapped around the inner rubber portion, wherein the flexible steel plate assembly comprises a plurality of arch-shaped flexible steel plates; the arch-shaped flexible steel plates are mutually combined and spliced in a successive lap joint manner to form a cylindrical structure with a waist sunken; and the inner rubber portion is arranged in the cylindrical structure.

2. The high-pressure bearable scale type bridge rubber bearing according to claim 1, wherein a zigzag type splicing opening is formed between adjacent arch-shaped flexible steel plates; and in a cross section, an upper steel plate of each arch-shaped flexible steel plate is successively in lap joint to a lower steel plate of the arch-shaped flexible steel plate before.

3. The high-pressure bearable scale type bridge rubber bearing according to claim 1, wherein the outer side surface of the outer rubber portion is a sunken arch-shaped curved surface.

4. A high-pressure bearable scale type bridge rubber bearing, comprising spring rubber vibration reduction pad assemblies, a flexible steel plate assembly and a rubber bearing body, wherein the rubber bearing body comprises an outer rubber portion and an inner rubber portion; the outer rubber portion is wrapped around the outside of the spring rubber vibration reduction pad assemblies and the flexible steel plate assembly; the spring rubber vibration reduction pad assemblies are arranged on the upper side and the lower side of the inner rubber portion; the flexible steel plate assembly is fixedly mounted between the spring rubber vibration reduction pad assemblies; and spring rubber vibration reduction assemblies and the flexible steel plate assembly are wrapped around the inner rubber portion, wherein each spring rubber vibration reduction pad assembly comprises an upper steel plate layer, a lower steel plate layer, fixing bolts, springs and fixed columns; a plurality of fixed columns are fixedly arranged on the upper surface of the lower steel plate layer at uniform intervals; threaded holes are formed in the fixed columns; through holes are formed in the upper steel plate layer; the upper steel plate layer is fixed to the fixed columns by the fixing bolts penetrating through the through holes; and the springs are sleeved at the peripheries of the fixed columns.

5. The high-pressure bearable scale type bridge rubber bearing according to claim 4, wherein the fixed columns are specifically arranged in a circular array; and heights of the springs sleeved outside the fixed columns are identically set.

6. The high-pressure bearable scale type bridge rubber bearing according to claim 4, wherein a gasket is arranged between each fixing bolt and the upper surface of the upper steel plate layer.

7. The high-pressure bearable scale type bridge rubber bearing according to claim 4, wherein the fixed column is of an eccentric elliptic platform shaped structure; and an ellipse on the bottom surface, an ellipse on the top surface and the side surface of an eccentric elliptic platform form a symmetric key shaped body.

8. The high-pressure bearable scale type bridge rubber bearing according to claim 7, wherein a length of a long axis of the ellipse on the bottom surface of the fixed column is consistent to a radius of the spring.

9. The high-pressure bearable scale type bridge rubber bearing according to claim 4, wherein each fixed column is made of rubber with viscoelasticity, weak hardness and high damping.

* * * * *